United States Patent [19]

Ostrowsky

[11] 4,133,449

[45] Jan. 9, 1979

[54] PLASTIC CONTAINER

[75] Inventor: Efrem M. Ostrowsky, Highland Park, Ill.

[73] Assignee: Ethyl Products Company, Baton Rouge, La.

[21] Appl. No.: 599,769

[22] Filed: Jul. 28, 1975

[51] Int. Cl.[2] ..... B65D 43/16

[52] U.S. Cl. ..... 220/339; 220/306; 220/283

[58] Field of Search ..... 220/339, 337, 315, 306, 220/283

[56] References Cited

U.S. PATENT DOCUMENTS

| | | | |
|---|---|---|---|
| 3,381,850 | 5/1968 | Haugen | 220/337 X |
| 3,894,655 | 7/1975 | Mattheis et al. | 220/283 |

*Primary Examiner*—William Price
*Assistant Examiner*—Steven M. Pollard
*Attorney, Agent, or Firm*—Donald L. Johnson; John F. Sieberth; Edgar E. Spielman, Jr.

[57] ABSTRACT

An integrally formed, one-piece, generally rectangular, plastic container particularly adapted for holding medicines is disclosed. The container includes a generally rectangular bottom section which is connected to a rectangular top section by means of an integrally formed, flexible, plastic hinge at the rear of the two sections. In the closed position, the top section overlies the bottom section and latch means lock the two sections together. The bottom section has a planar bottom wall, two opposed, upturned sidewalls, an upturned front wall, and an upturned back wall, all of which are integrally formed and connected to each other. The top section has a planar top wall, two downturned sidewalls and a downturned front wall, all of which are integrally formed and connected to each other, and a downturned back wall integrally formed and connected to the top wall. The thickness of the container at the connection of the downturned back wall and the top wall is reduced. Also the downturned back wall and the top wall are joined so as to form an obtuse angle with each other. The container requires that equal pressure be applied to the rear corners thereof in order to disengage the latch means. The container provides a substantially child-proof safety closure for tableted medicines such as aspirin, laxatives, cold tablets, prescription drugs, etc.

11 Claims, 14 Drawing Figures

PLASTIC CONTAINER

BACKGROUND OF THE INVENTION

1. Field of the Invention

This invention relates to a one-piece, integrally formed, generally rectangular, plastic box particularly suited for packaging medicines.

2. Description of the Prior Art

Many medicines such as aspirin have conventionally been packaged in generally rectangular, two-piece, metal containers having a top rectangular section which is hingedly connected to a rectangular bottom section. Earlier boxes utilized a conventional pinned hinge arrangement at the rear thereof to join the two components together. More recent two-piece boxes are connected by means of matching projections and recesses provided on each sidewall of the box slightly forward of the rear thereof (see U.S. Pat. No. 2,906,428). These boxes are opened by applying pressure to the rear of the box.

Recent FDA regulations will require that aspirin tablets and a number of items be packaged in special containers which have "childproof" features. The containers must not be openable by children under a certain age in a certain number of attempts to open the containers. Satisfactory closures have been developed for bottle-type containers for aspirin and prescription drugs and other items which may be potentially dangerous to children. However, difficulty has been encountered in producing a satisfactory rectangular, two-piece, hinged, conventional container for packaging tablets. The problem has primarily been one of the developing a container which has a consistent opening pressure, such that only pressure applied by an adult can open the container. Erratic opening pressures utilizing the conventional engaging means for the closure, i.e. the projection on the front of the lower portion of the container which is engaged in a recess in the front wall of the upper portion of the container, together with the difficulty in producing the recesses and protrusions which form the hinge mechanism of the container, have prevented the conventional metal tablet box from qualifying as a childproof container.

The present invention overcomes numerous disadvantages of previously used containers in that it can be readily prepared by utilization of flexible plastic materials and has reproducible opening and closing characteristics rendering it eminently suitable for use in packaging medicines.

SUMMARY OF THE INVENTION

It is an object of the present invention to provide an integrally formed, plastic container suitable for holding tablets.

It is another object of the present invention to provide an integrally formed, plastic container having reproducible opening characteristics.

It is still another object of the present invention to provide an integrally formed, plastic container which can qualify for certification as "childproof".

It is a still further object of the present invention to provide an injection molded, plastic container having two components joined by a "living hinge".

The foregoing objects and other advantages that are brought out hereinafter are realized in the container of the present invention in an integrally formed, one-piece plastic container which has a generally rectangular bottom section having a planar bottom wall, two opposed, upturned sidewalls, an upturned front wall, and an upturned back wall, all of which are integrally formed and connected to each other. The container also has a top section having a planar top wall, two downturned sidewalls, and a downturned front wall, all of which are integrally formed and connected to each other, and a downturned back wall integrally formed and connected to said top wall by means of an integrally formed flexing joint. The top wall and the downturned back wall are connected at an obtuse angle. Integrally formed hinge means are provided which connect the back wall of the top section to the back wall of the bottom section. The top section is adapted to overlie the bottom section and to be frictionally engaged therewith when the container is in the closed position.

The present invention provides many advantages over those containers previously utilized for packaging medicants such as aspirin. The present container is readily formed of plastic material such as medium, low or high density polyethylene, polypropylene, or other semi-rigid plastic materials which can be readily injection molded. The device can be produced by preferably injection molding these thermoplastics to produce an integrally formed container having two rectangular compartments connected by a living hinge. The present container has reproducible opening characteristics which will qualify it as a "childproof" container.

Contributing to the reproducible opening characteristics of the container of this invention are the flexing joint which connects the top wall and the downturned back wall of the top section and the connection of the top wall and the downturned back wall to form an obtuse angle. With this arrangement, when pressure is applied to the two rear corners of the top wall the downturned back wall will flex downwardly and forwardly thus pushing the top section forward and upward so that the latch mechanisms can be released. The flexing joint enables the top wall to move further forward from the downturned back wall than would be possible if the two were connected with a non-flexing or hard-to-flex connection. Since the top section is able to move so far forward, unlatching of the latch mechanism is easily achieved when and only when both rear corners of the container are pressed downwardly. An advantage of utilizing a flexing joint and forming the obtuse angle is that the user of the container of this invention need only press the corners downwardly. There is no need for the user to press the corners downwardly and forwardly as was the case in prior art plastic aspirin containers. The forward pushing is particularly not desirable when it is considered that containers which contain pain-relieving ingredients such as aspirin are oftentimes utilized by the arthiritic or aged and thus their opening should be made as convenient as possible without a loss of childguarding features.

DESCRIPTION OF THE PREFERRED EMBODIMENTS

Figure 1:
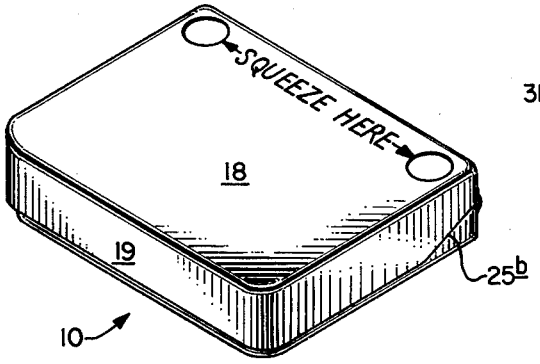
FIG. 1 is a perspective, elevational view of the container of the present invention showing the container in a closed position.
Figure 4C:
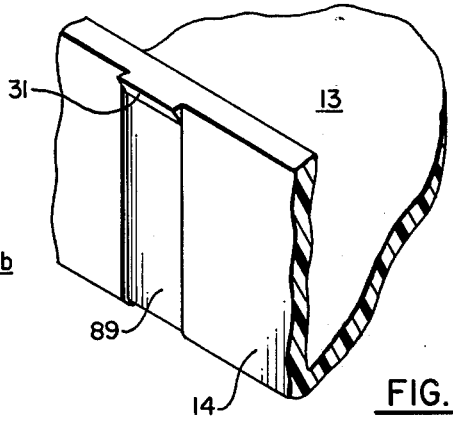
FIG. 4C is a broken, enlarged, perspective view of the latch of the container as seen in FIG. 3.

Referring now to FIGS. 1–5, 4A and 5A, the container of the present invention is characterized in that it is made from one integrally formed piece of semi-flexible plastic material. The container, designated generally by the reference numeral 10, is composed of two sections—a bottom section, designated generally by the numeral 11, and a top section, designated generally by the numeral 12. The bottom section 11 includes a generally rectangular planar bottom wall 13 which is integrally connected to an upturned front wall 14. The front wall 14 and the bottom wall 13 are integrally formed with and connected to opposed, upturned sidewalls 15 and 16. The bottom section has a rear wall 17 which is integrally formed with and projects upward at a slight obtuse angle from the bottom wall 13. The rear wall 17 is slightly less than one-half of the height of the front wall and sidewalls of the bottom section. The bottom section sidewalls and front wall and the top section sidewalls and front wall are preferably all of equal height. By these walls being of equal height the container can then be easily handled with maximum efficiency in printing, filling, and closing automatically. Also, it provides minimum exposed bottom side and front walls in the closed position for a child to force open the container.

The top section 12 of the container includes a generally planar top wall 18 which is integrally formed with and connected to a downturned (in the closed position) front wall 19. The top wall 18 and front wall 19 are integrally formed with and connected to two opposed sidewalls 20 and 21. Top wall 18 has integrally formed therewith a downwardly and rearwardly projecting rear wall 22. Top wall 18 and rear wall 22 form an obtuse angle with each other. Preferred angles are those within the range of from about 100 to about 135 degrees. A highly preferred range is from about 115 to about 125 degrees.

Figure 5A:
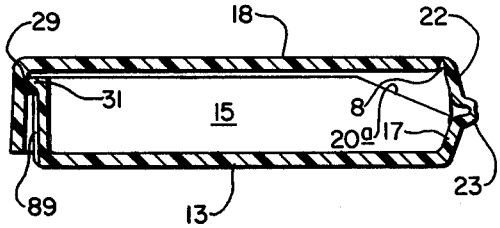
FIG. 5A is a cross-sectional view of the container of FIG. 5 taken along section lines 5A—5A.
Figure 2:
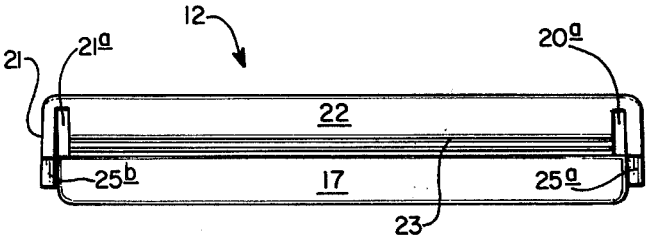
FIG. 2 is a rear view of the container shown in FIG. 1.
Figure 4A:
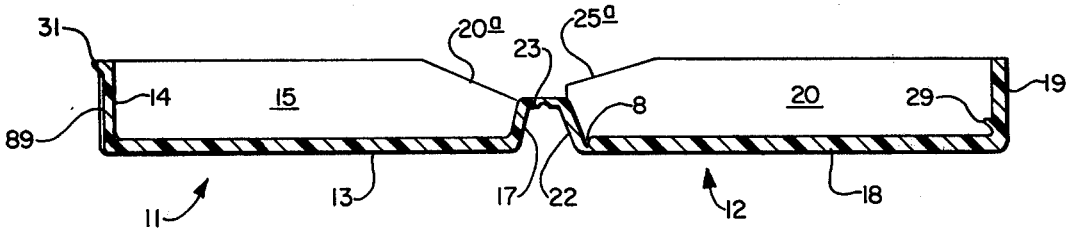
FIG. 4A is a cross-sectional view of the container of FIG. 4 along section lines 4A–4A.
Figure 3:
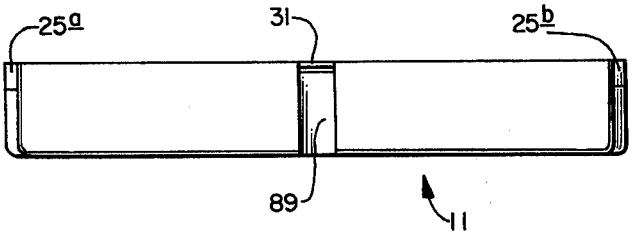
FIG. 3 is a front, elevational view of the container as shown in FIG. 4.
Figure 4B:
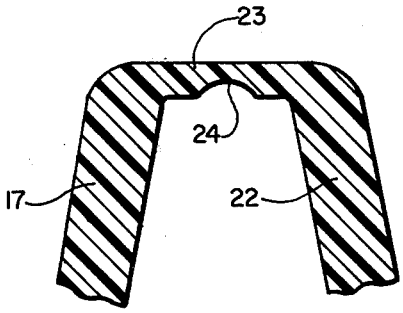
FIG. 4B is a broken, enlarged view of the hinge portion of the container as shown in FIG. 4A.
Figure 4:
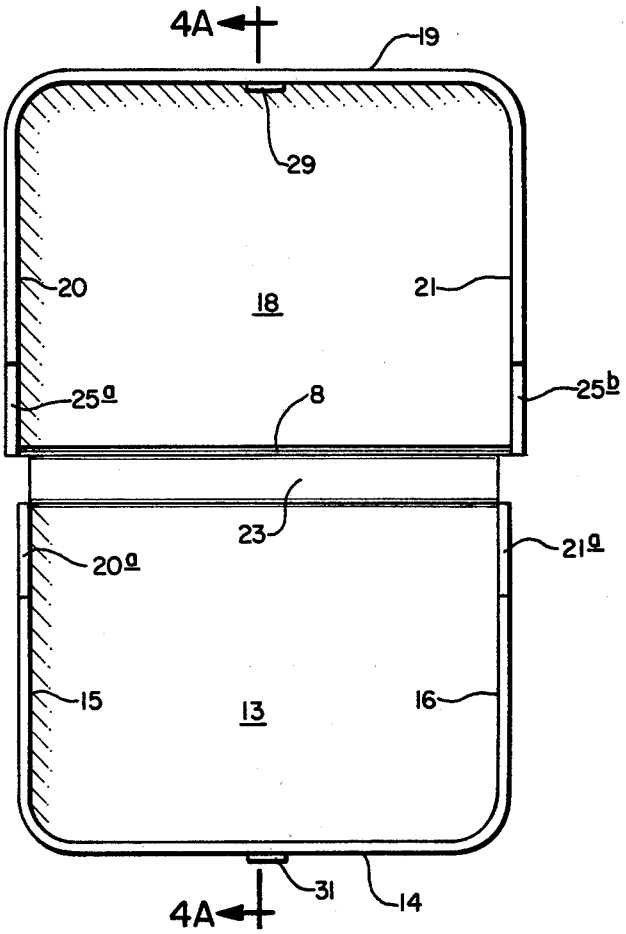
FIG. 4 is a top plan view of the container shown in FIG. 1 in the open position.
Figure 4E:
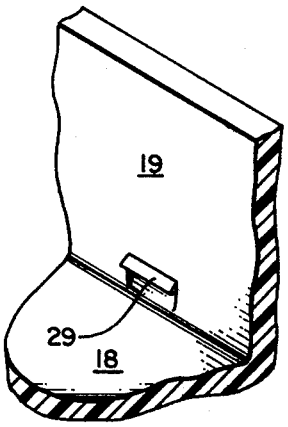
FIG. 4E is a broken, elevational, perspective view of the latch portion found in the top section of the container as seen in FIG. 4.
Figure 4D:
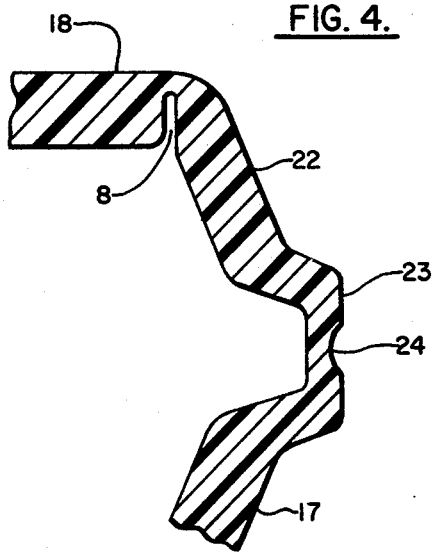
FIG. 4D is an enlarged, broken view of the hinge portion of the container shown in FIG. 5A.

Forming the connection between top wall 18 and downwardly and rearwardly projecting rear wall 22 is flexing joint 8. As can be seen in FIGS. 4D and 5A, flexing joint 8 can be provided by a groove running the length of the connection of top wall 18 and rear wall 22. As can also be seen from FIG. 4D, the container thickness at flexing joint 8 is considerably thinner than the thickness of rear wall 22 and top wall 18. By having a decreased thickness it is possible to achieve flexing between top wall 18 and rear wall 22 when downward pressure is applied to top wall 18. Preferably, flexing joint 8 will have a thickness less than onehalf the thickness of the container walls when the container is amde of plastics such as polypropylene or polyethylene. For polypropylene a joint thickness within the range of from about 0.010 to about 0.025 inches is preferred. For containers of other materials determination of flexing joint thickness is easily determined by simple trial and error until the required motion of the top section is achieved by a downward force of the top section as hereinbefore and hereinafter described.

The capability of flexing coupled with the obtuse angle formed between top wall 18 and rear wall 22 makes possible the forward shift in the top section 12 when pressure is applied to the rear corners thereof. When pressure is applied to the rear corners, rear wall 22 moves downward and forward thus camming the top section forward. Flexing joint 8 allows for rear wall 22 to move forward to its utmost extent without the requirement of high pressing forces at the rearward corners of the container. If there were no flexing joint achievement of forward motion of the top section could only be accomplished with the exertion of considerably more force than is required with the container of this invention, and with the exertion of force in a horizontal direction. As can be seen from the drawing, flexing joint 8 in the embodiment illustrated is a groove. It is to be understood of course that other structures may be utilized other than the groove to provide a flexing joint (e.g. example, intermittent spaced openings).

Closure of the container of this invention requires that top section 12 move in a path which is best described as being the reverse of the path moved by top section 12 when opening the container. When closing, top section 12 will be moved forward due to the camming action of the latch protrusions as hereinafter described. The forward movement of top section 12 will continue until the protrusions in top section 12 override the protrusions in bottom section 11. At this point, top section 12 will be moved rearwardly to maintain the latch. Movement of top section 12 rearwardly is achieved by the resiliency found in flexing joint 8 which causes rear wall 22 and top wall 18 to return to the relaxed position. Thus it is easy to see that this resiliency must be considered when determining the thickness of flexing joint 8. Flexing joint 8 should not be so thin that it is unable to provide the required resiliency to move top section 12 rearwardly when required to close the container.

Rear walls 22 and 17 are joined by an integrally formed living hinge section 23. As seen more clearly in FIGS. 4B and 4D, the hinge section 23 has a wall thickness which is substantially thinner than the wall thickness of the rear walls 22 and 17. Preferably, the wall thickness of the hinge section is about one-half or less of the thickness of the rear walls 17 and 22. The longitudinally extending groove 24 (which may be in any particular form, but is shown in the drawings as a semicircular groove) extends the full length of the hinge section. The groove provides a weakening of the major flexing portion of the hinge element 23 to facilitate easy flexure of the hinge element 23 when opening and closing the container.

Referring now to FIGS. 1, 3, 4, 4A and 5A, it can be seen that bottom section 11 and top section 12 of the container have their sidewalls 15, 16, 20 and 21 respectively provided with rearwardly tapered sections 20*a* and 21*a* for walls 15 and 16 and tapered sections 25*a* and 25*b* for walls 20 and 21. Tapered sections 20*a* and 21*a* serve to provide a pivotal point upon which top section 12 will pivot upon application of pressure thereon. The pivot point is formed by the intersection of tapered sections 20*a* and 21*a* with sidewalls 15 and 16. When top section 12 is pressed downwardly top wall 18 contacts the above-described pivot point causing the front portion of top section 12 to pivot upwardly in response to the downward pressure. This upward motion of the front portion of top section 12 is useful in aiding the disengagement of the two sections when unlatching is performed.

Tapered sections 25*a* and 25*b* provide clearance so that the rear corners of top section 12 do not press into the fingers of the user while pressing on the top section. Also there will be no interference with the action of the container of this invention when it is opened by pressing down on the corners of top section 12 when the container is resting upon a table.

Figure 4F:
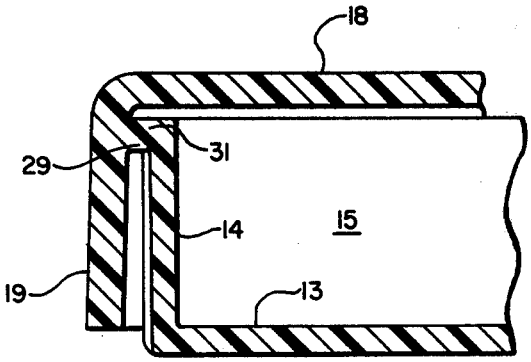
FIG. 4F is an enlarged, broken, sectional view of the forward portion of the container of FIG. 5A showing the details of the engagement of the latch means.
Figure 5:
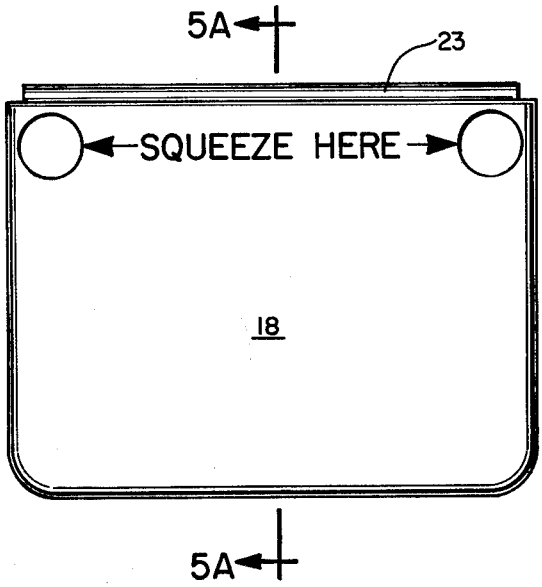
FIG. 5 is a top plan view of the container shown in FIG. 1 in the closed position.
Figure 6:
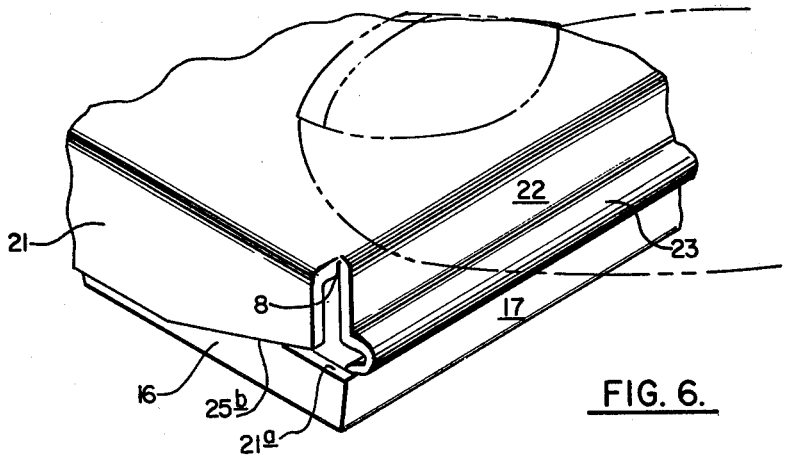
FIG. 6 is a broken, perspective view of a rear corner of the container of FIG. 1 prior to force being exerted upon the top of the container by a human finger.
Figure 6A:
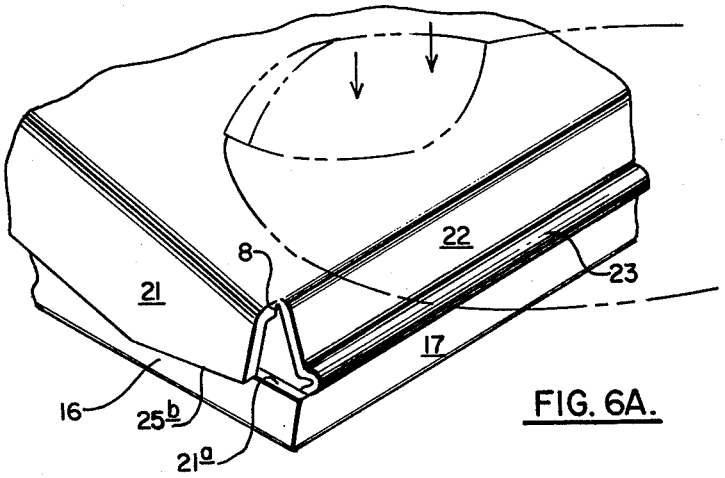
FIG. 6A is the same view as FIG. 6 except that the rear corner is shown after the force has been exerted thereon by the human finger.

Referring now to FIGS. 3, 4, 4A and 4F, the upper or top section of the container 12 and the bottom or lower section 11 of the container are held in the closed position, as seen in FIGS. 1, 4F, 5 and 5A, by means of a center latch. The latch includes an integrally formed, short, longitudinally extending protrusion 29 on the inside wall of the front wall 19 of the top section 12 of the container. The top protrusion 29 is adapted to engage and interlock with outside protrusion 31 which is integrally formed with and projects from the upper edge of the outside wall of the front wall 14 of the lower section of the container. Beneath protrusion 31 is channel 89. This channel is optional and serves to give protrusion 31 more depth for obtaining attachment with top protrusion 29. As seen more clearly in FIG. 4F, when the top section of the container is folded over and pressed downwardly over the bottom section of the container, the two sections are latched together by engagement of the respective protrusions on the top section and bottom section of the container. While the protrusions on each section of the container are shown in FIG. 4F with sloping engaging walls, the protrusions may have transverse walls on the engaging surfaces, if desired. Also it is to be understood that multiple latches, e.g. two latches, may also be used when desired.

In order to open the closed container, an adult will take the container in both hands and position the left- and right-hand rear corners of the box between the thumb and forefinger of the left and right hands respectively and apply a downward pressure with the thumbs. This will cause rear wall 22 to pivot forward about its connection with hinge 23 thus forcing forward top wall 18. Allowing top wall 18 to extend a distance sufficient enough to release the latch is flexing joint 8. After the latch has been deactivated continued downward pressure will force the front portion of top wall 18 to rise upwardly thus exposing the contents of the container.

The container of the present invention may be fabricated from any suitable, flexible, thermoplastic material. Suitable thermoplastic materials are high, medium and low density polyethylene, polypropylene, and copolymers of ethylene and propylene with other monomers, plasticized PVC and copolymers of vinyl chloride with other monomers. Any plastic material which is sufficiently flexible to make operable an integrally formed, living hinge, i.e. hinge 23, and can give the flex required by flexing joint 8 can be used in the container of the present invention. The preferred material is polypropylene. As before noted, the thicknesses of the hinge element 23, flexing joint 8 and the rear walls 17 and 22 of the container can be readily determined by experiment to provide the proper resistance to application of pressure to insure against accidental opening of the container. Additionally, the thicknesses of these members, together with that of the top wall 18, may be suitably adjusted in order to require the application of a specific number of ounces of compression upon each corner of the container before the latches will release. The container of the present invention may be easily formed by injection molding or by thermoforming suitable plastic material. The container is suitable for packaging medicants in that it can be designed to provide a "child-proof" container.

While there has been described what is considered preferred embodiments of the present invention, it is understood that apparatus and design changes may be utilized for constructing and operating the container of the present invention. For example, instead of the latch members utilizing sloping surfaces on their engaging faces, these members may be made in the form of a generally rectangular protrusion whereby a more vigorous and forceful application of pressure will have to be applied to the rear of the top cover of the container in order to release these latch members. Additionally, if desired, grooved or serrated surfaces may be provided at the top corners of the top and/or bottom sections of the container to secure a better grip on the container when applying pressure thereto for opening the container.

What is claimed is:

1. In an integrally formed, one-piece plastic container having a bottom section and an overlying top section hinged to said bottom section;

said bottom section being characterized in that it has a planar bottom wall, two opposed, upturned sidewalls, an upturned back wall, and an upturned front wall, all of which are integrally formed and connected to each other, said upturned front wall carrying top latching lug means; and said top section being characterized in that it has a planar top wall, two opposed downturned sidewalls, a downturned front wall, all of which are integrally formed and connected to each other and a downturned back wall integrally formed and connected to said top wall, said downturned front wall carrying bottom latching lug means for engaging said lug means on said upturned front wall of said bottom section to latch said top section to said bottom section;

the improvement which comprises: said downturned back wall and said planar top wall being connected one to the other to form an obtuse angle therebetween and said planar top wall and said downturned back wall are connected by flexing joint means having a web of plastic material with a thickness of less than one-half the thickness of said back wall and said planar top wall whereby said flexing joint means allows said planar top wall to move forward upon application of downward pressure to the two rearmost corners of said top section so that said top and bottom latching lug means will disengage to allow said container to be unlatched.

2. The container of claim 1 wherein said flexing joint means includes a web of plastic material having a thickness of from about 0.010 to about 0.025 inches.

3. The container of claim 1 wherein both of said back walls are less than one-half the height of the adjacent sidewalls.

4. The container of claim 1 wherein said hinge means includes a web of plastic material having a thickness of less than one-half the thickness of said back walls.

5. The container of claim 1 wherein said front walls and said sidewalls of both sections are all of equal height.

6. The container of claim 1 wherein said latching lug means in said bottom section is a projection provided adjacent the upper edge of the outer wall of said upturned front wall and the latching lug means in said top section is a projection provided adjacent the upper edge of the inner wall of said downturned front wall.

7. The container of claim 1 wherein the container is made of polypropylene.

8. The container of claim 1 wherein; said latching lug means in said bottom section is a projection provided adjacent the upper edge of the outer wall of said upturned front wall and the latching lug means in said top section is a projection provided adjacent the upper edge of the inner wall of said downturned front wall.

9. The container of claim 9 wherein said flexing joint means has a thickness of from about 0.010 to about 0.025 inches.

10. The container of claim 10 wherein said container is made of polypropylene.

11. The container of claim 11 wherein said hinge means includes a web of plastic material having a thickness of less than one-half the thickness of said back walls.

* * * * *

UNITED STATES PATENT AND TRADEMARK OFFICE

CERTIFICATE OF CORRECTION

PATENT NO. :4,133,449

DATED :January 9, 1979

INVENTOR(S) :Efrem M. Ostrowsky

It is certified that error appears in the above-identified patent and that said Letters Patent are hereby corrected as shown below:

Col. 8, line 11 reads "9", should read -- 8 --.
Col. 8, line 14 reads "10" should read -- 9 --.
Col. 8, line 16 reads "11" should read -- 10 --.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*